US011146019B1

(12) United States Patent
Hunnicutt et al.

(10) Patent No.: US 11,146,019 B1
(45) Date of Patent: Oct. 12, 2021

(54) SLIDING ELECTRICAL OUTLET ASSEMBLY

(71) Applicants: Marianne Hunnicutt, Nashville, TN (US); Michael Hunnicutt, Nashville, TN (US); Victoria Keyser, Nashville, TN (US)

(72) Inventors: Marianne Hunnicutt, Nashville, TN (US); Michael Hunnicutt, Nashville, TN (US); Victoria Keyser, Nashville, TN (US)

( * ) Notice: Subject to any disclaimer, the term of this patent is extended or adjusted under 35 U.S.C. 154(b) by 0 days.

(21) Appl. No.: 16/990,630

(22) Filed: Aug. 11, 2020

(51) Int. Cl.
*H01R 13/502* (2006.01)
*H01R 13/514* (2006.01)
*H01R 13/518* (2006.01)

(52) U.S. Cl.
CPC ..... *H01R 13/514* (2013.01); *H01R 13/518* (2013.01)

(58) Field of Classification Search
CPC ... H01R 13/514; H01R 13/516; H01R 13/518
USPC ..... 439/535, 701
See application file for complete search history.

(56) References Cited

U.S. PATENT DOCUMENTS

| | | | |
|---|---|---|---|
| 4,489,995 | A | 12/1984 | Barr |
| 5,052,937 | A | 10/1991 | Glen |
| 5,203,711 | A | 4/1993 | Bogiel |
| 5,292,257 | A | 3/1994 | Milan |
| 7,258,555 | B2 | 8/2007 | Tiesler |
| 9,325,132 | B2 | 4/2016 | Hsu |

*Primary Examiner* — Khiem M Nguyen

(57) ABSTRACT

A sliding electrical outlet assembly includes a housing that can be coupled to a vertical support surface and the housing has a slot extending into an interior of the housing. A first contact is integrated into the housing and the first contact is electrically coupled to a power source. A second contact is integrated into the housing and the second contact is electrically coupled to the power source. A plurality of outlet units is each slidably insertable into the slot. Each of the outlet units engages the first contact and the second contact when the outlet units are rotated into a locked position to supply electrical power for an electrical device. Each of the outlet units is slidable along the slot to facilitate electrical power for the electrical device to be located at a plurality of locations along the vertical support surface.

15 Claims, 6 Drawing Sheets

SLIDING ELECTRICAL OUTLET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to sliding outlet devices and more particularly pertains to a new sliding outlet device for facilitating electrical outlets to be slidably positioned on a wall.

(2) Description of Related Art Including Information Disclosed Under 37 CFR 1.97 and 1.98

The prior art relates to sliding outlet devices including a merchandise cabinet that has a plurality of shelves which each has a plurality of electrical outlets being movably integrated therein. The prior art discloses a slidable outlet device that includes a housing with a slot and a plurality of outlets that are slidably insertable into the slot. The prior art discloses a variety of power tracks that each includes a plurality of outlets that are slidably coupled thereto. The prior art also discloses a modular power strip assembly for adding or removing electrical outlets from the modular power strip.

BRIEF SUMMARY OF THE INVENTION

An embodiment of the disclosure meets the needs presented above by generally comprising a housing that can be coupled to a vertical support surface and the housing has a slot extending into an interior of the housing. A first contact is integrated into the housing and the first contact is electrically coupled to a power source. A second contact is integrated into the housing and the second contact is electrically coupled to the power source. A plurality of outlet units is each slidably insertable into the slot. Each of the outlet units engages the first contact and the second contact when the outlet units are rotated into a locked position to supply electrical power for an electrical device. Each of the outlet units is slidable along the slot to facilitate electrical power for the electrical device to be located at a plurality of locations along the vertical support surface.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
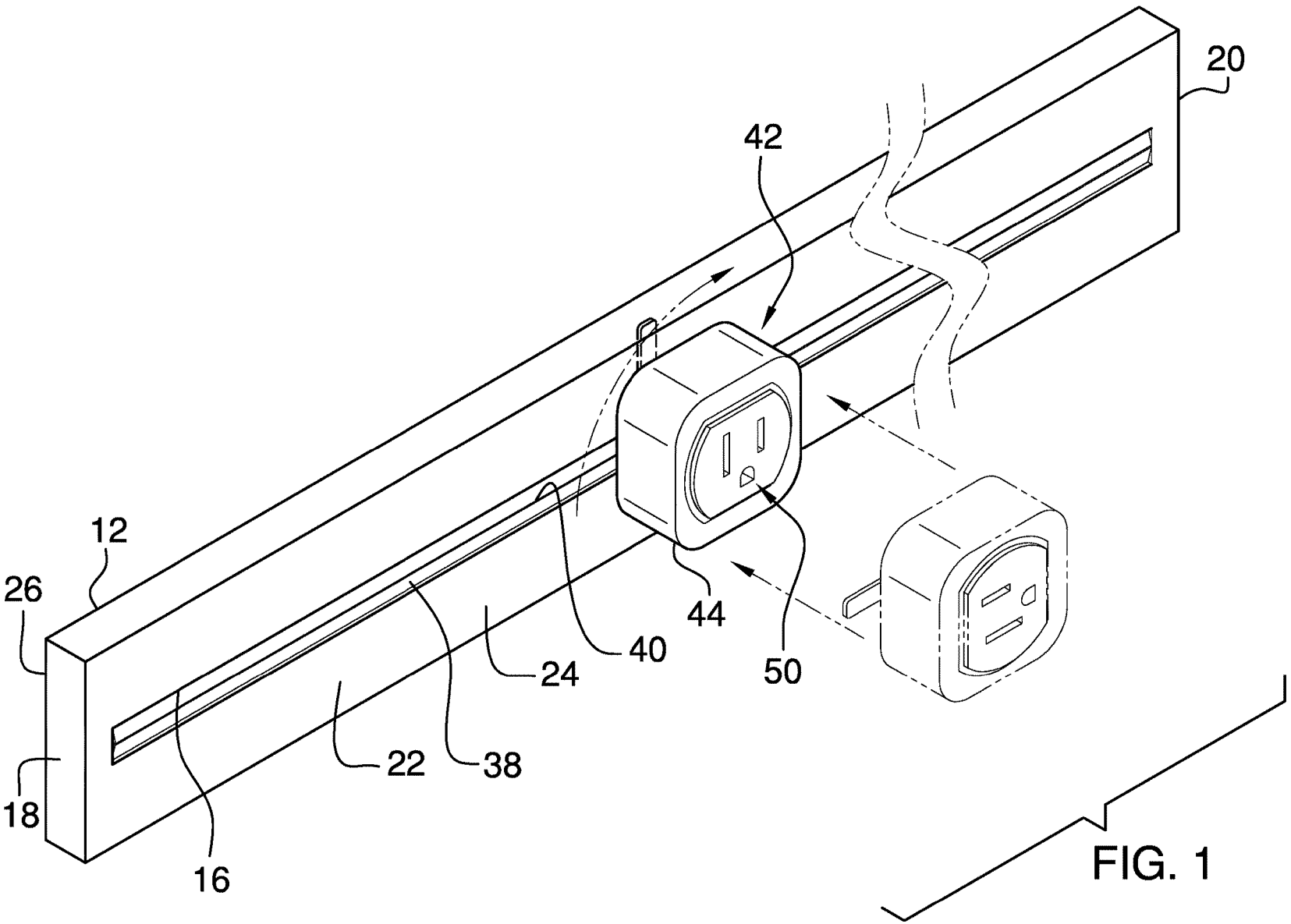
FIG. 1 is a perspective view of a sliding electrical outlet assembly according to an embodiment of the disclosure.
Figure 2:
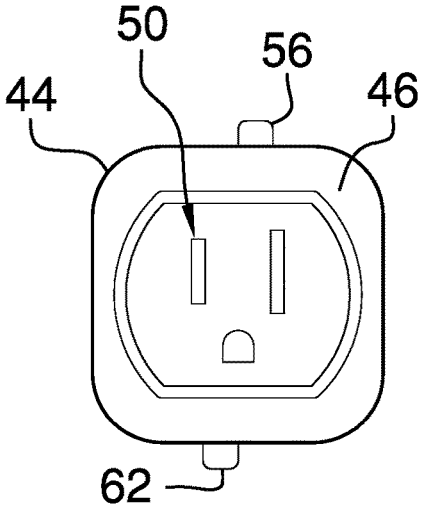
FIG. 2 is a front view of an outlet unit of an embodiment of the disclosure.
Figure 3:
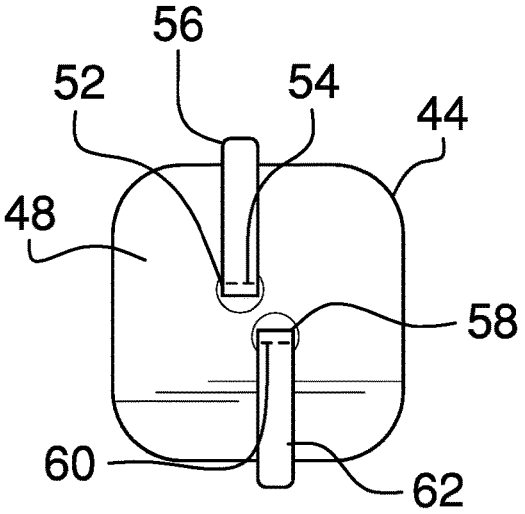
FIG. 3 is a back view of an outlet unit of an embodiment of the disclosure.
Figure 4:
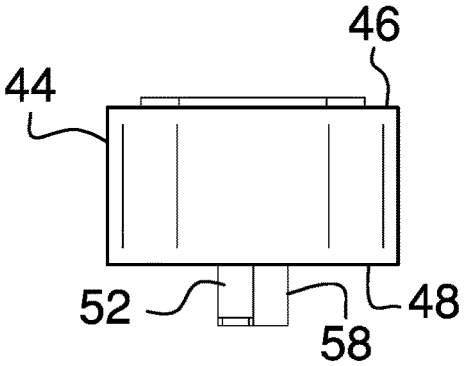
FIG. 4 is a top view of an outlet unit of an embodiment of the disclosure.

With reference now to the drawings, and in particular to FIGS. 1 through 8 thereof, a new sliding outlet device embodying the principles and concepts of an embodiment of the disclosure and generally designated by the reference numeral 10 will be described.

As best illustrated in FIGS. 1 through 8, the sliding electrical outlet assembly 10 generally comprises a housing 12 that is coupled to a vertical support surface 14, such as a wall in a room of a building. The housing 12 has a slot 16 extending into an interior of the housing 12. The housing 12 has a first end 18, a second end 20 and an outer wall 22 extending therebetween, and the outer wall 22 has a front side 24 and a back side 26. The housing 12 is elongated between the first end 18 and the second end 20, and the housing 12 has a chamber 28 therein. The slot 16 extends through the front side 24 of the outer wall 22 into the chamber 28 and the slot 16 extends substantially between the first end 18 and the second end 20. The housing 12 is oriented such that an axis extending through the first end 18 and the second end 20 is horizontally oriented. The back side 26 of the outer wall 22 abuts the vertical support surface 14 and the chamber 28 has a rear bounding surface 30.

A first contact 32 is integrated into the housing 12 and the first contact 32 is coextensive with the slot 16. The first contact 32 is electrically coupled to a power source 34 comprising an electrical system of the building. The first contact 32 is positioned on the rear bounding surface 30 of the chamber 28 and the first contact 32 is coextensive with the slot 16. The first contact 32 is offset from the slot 16 and the first contact 32 is comprised of an electrically conductive material.

A second contact 36 is integrated into the housing 12 and the second contact 36 is coextensive with the slot 16. The second contact 36 is electrically coupled to the power source 34. The second contact 36 is positioned on the rear bounding surface 30 of the chamber 28 and the second contact 36 is coextensive with the slot 16. The second contact 36 is offset from the slot 16 having the second contact 36 being spaced from the first contact 32. Additionally, the second contact 36 is comprised of an electrically conductive material.

A barrier 38 is provided and the barrier 38 is coupled to the housing 12. The barrier 38 covers the slot 16 to inhibit debris from entering the slot 16. Additionally, the barrier 38 has a cut 40 therein and the cut 40 extends along a full length of the slot 16. The barrier 38 may be comprised of a resiliently deformable material such as rubber or the like.

A plurality of outlet units 42 is provided and each of the outlet units 42 is slidably insertable into the slot 16. Each of the outlet units 42 engages the first contact 32 and the second contact 36 when the outlet units 42 are rotated into a locked position. In this way each of the outlet units 42 can supply electrical power for an electrical device. Each of the outlet units 42 is slidable along the slot 16 to facilitate electrical power for the electrical device to be located at a plurality of locations along the vertical support surface 14. In this way a room with poorly located electrical outlet, or with too few electrical outlets, can be improved with respect to facilitating the use of electrical devices.

Each of the outlet units 42 comprises a block 44 that has a forward side 46 and a rear side 48, and the forward side 46 has a female electrical outlet 50 integrated therein. Each of the outlet units 42 includes a primary contact 52 that is coupled to the rear side 48 and the primary contact 52 is electrically coupled to the female electrical outlet 50. The primary contact 52 is comprised of an electrically conductive material. The primary contact 52 comprises a leg 54 extending away from the rear side 48 and a foot 56 that is spaced from the rear side 48. The foot 56 extends upwardly along the block 44 and the primary contact 52 is extendable through the slot 16 in the housing 12 when the block 44 is oriented in an inserting position. Additionally, the primary contact 52 electrically engages the first contact 32 when the block 44 is rotated into a locking position. In this way the female electrical outlet 50 receives electrical power from the power source 34.

Each of the outlet units 42 includes a secondary contact 58 that is coupled to the rear side 48 and the secondary contact 58 is electrically coupled to the female electrical outlet 50. The secondary contact 58 is comprised of an electrically conductive material. The secondary contact 58 comprises a leg 60 extending away from the rear side 48 and a foot 62 that is spaced from the rear side 48. The foot 62 of the secondary contact 58 extends downwardly along the block 44 and the foot 62 of the secondary contact 58 is offset from the foot 56 of the primary contact 52. The secondary contact 58 is extendable through the slot 16 in the housing 12 when the block 44 is oriented in the inserting position. The secondary contact 58 electrically engages the second contact 36 when the block 44 is rotated into a locking position to receive electrical power from the power source 34.

Figure 5:
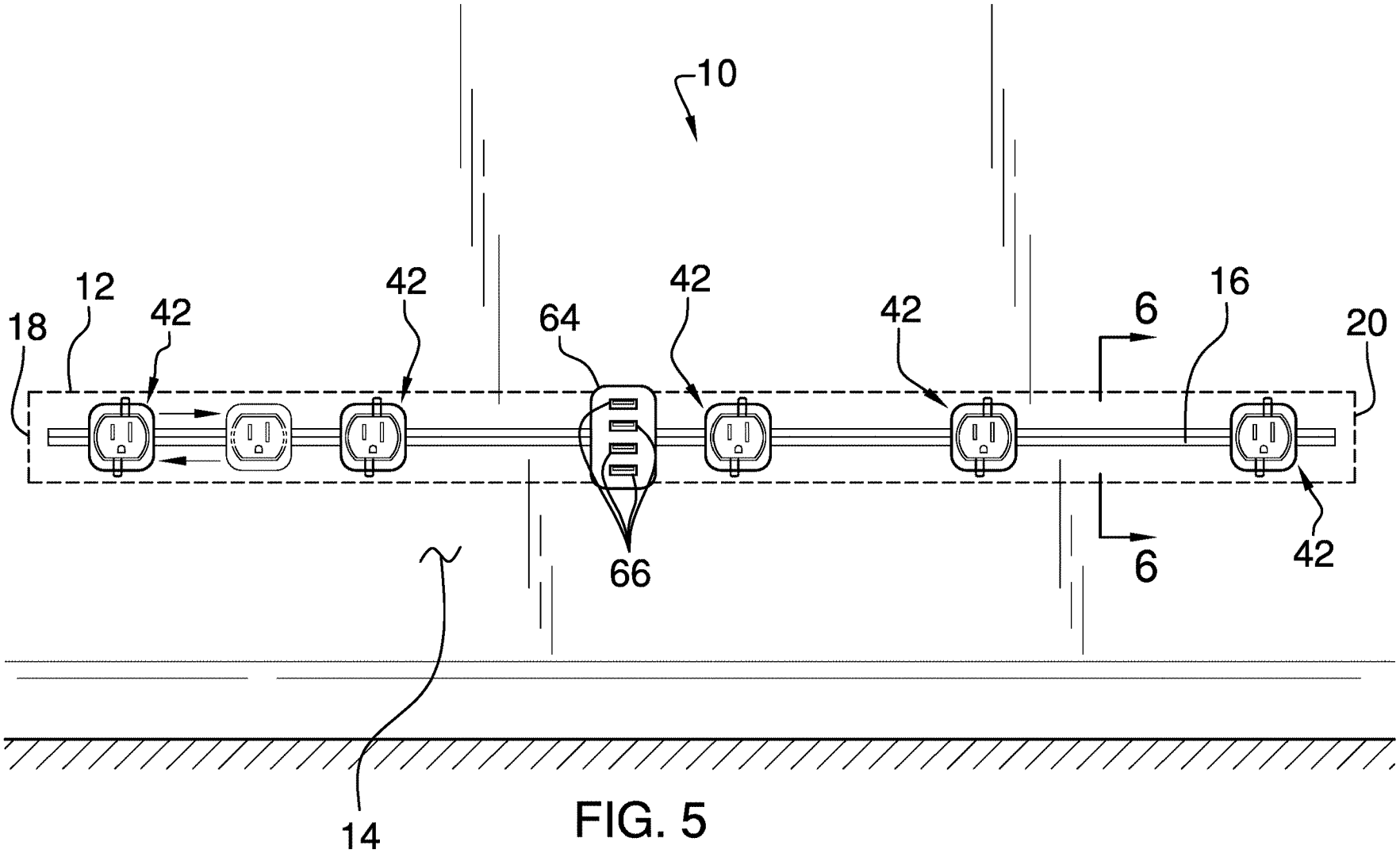
FIG. 5 is a perspective in-use view of an embodiment of the disclosure.
Figure 6:
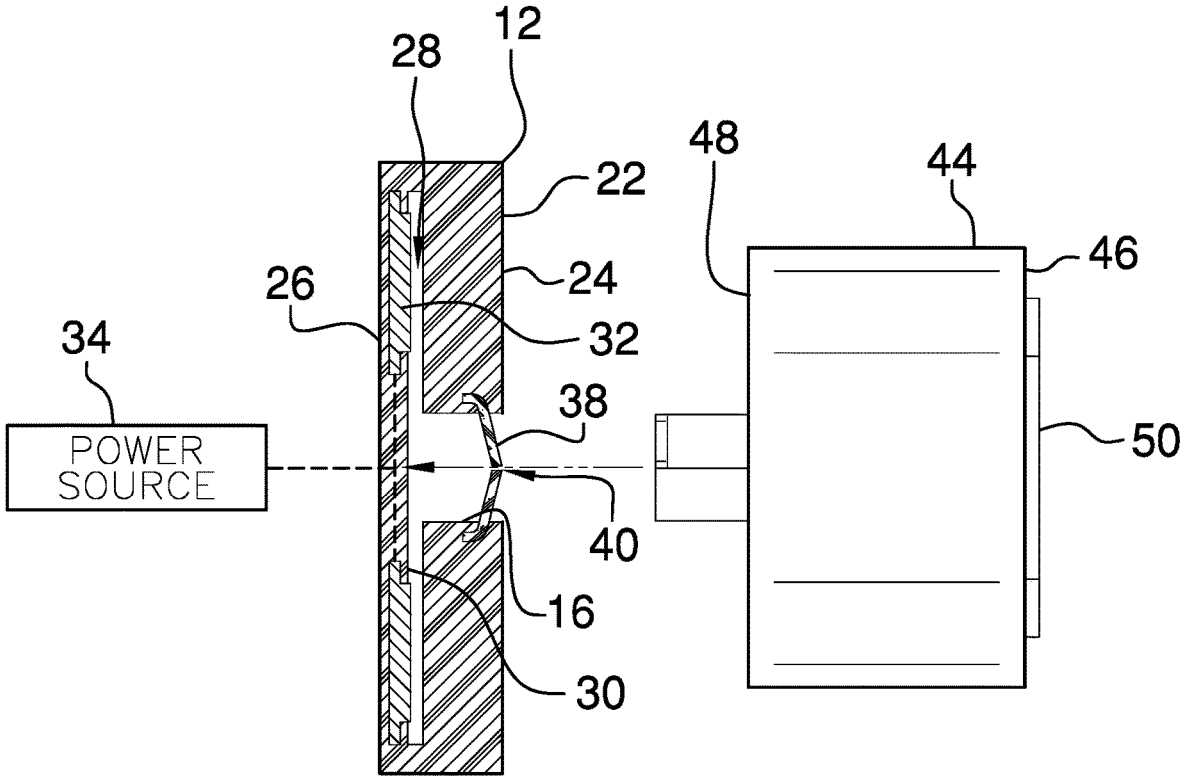
FIG. 6 is a cross sectional view taken along line 6-6 of FIG. 5 of an embodiment of the disclosure.

As is most clearly shown in FIG. 5, the plurality of outlet units 42 includes a charge block 64 which has a plurality of charge ports 66 each recessed into the forward side 46 of the block 44. In this way each of the charge ports 66 can insertably receive a charge cord for an electronic device, such as a smart phone or the like. Additionally, each of the charge ports 66 may comprise a usb port or other type of standardized charge port.

Figure 7:
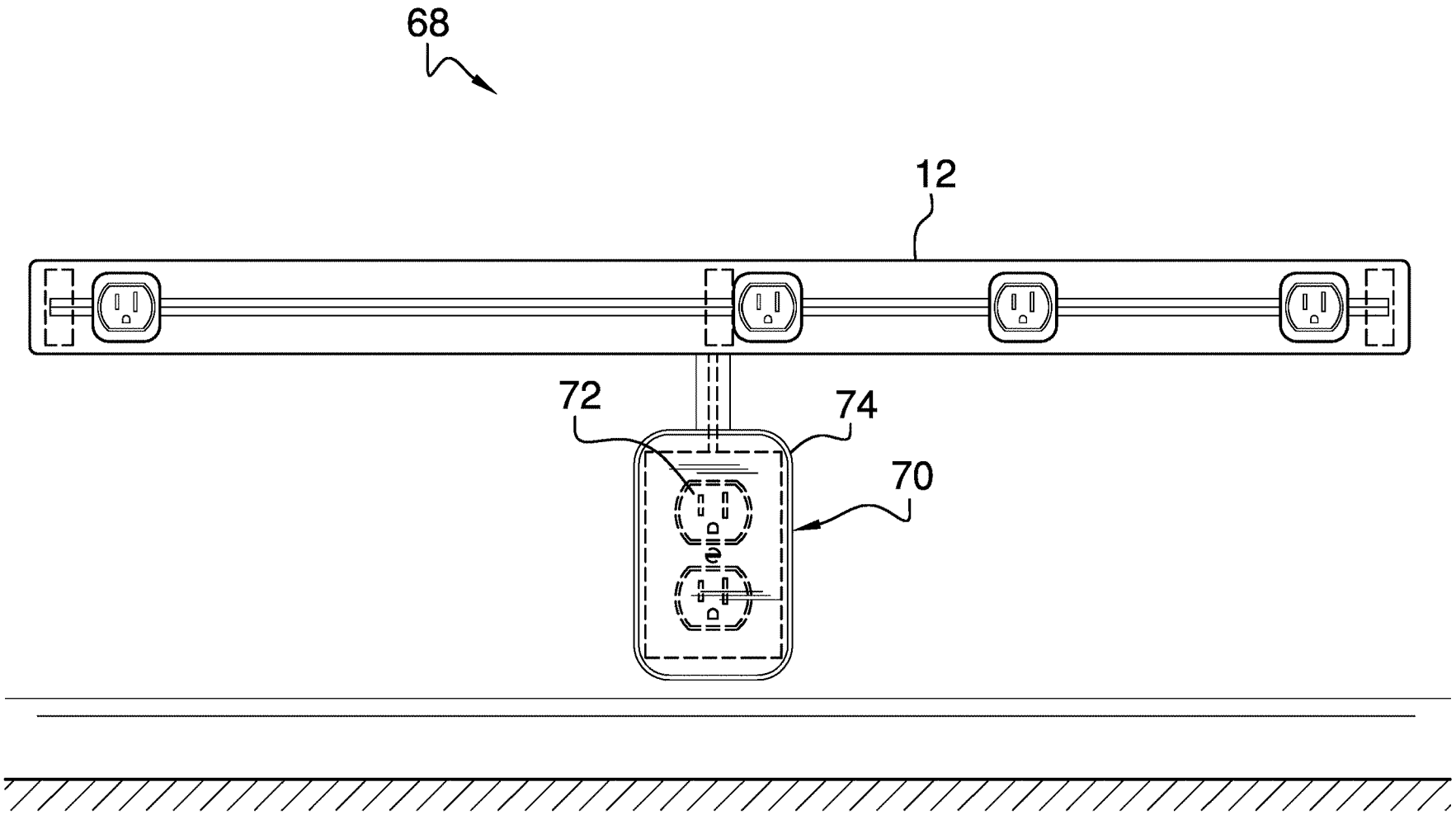
FIG. 7 is a perspective view of an alternative embodiment of the disclosure.

In an alternative embodiment 68 as is most clearly shown in FIG. 7, an outlet engagement 70 is provided that is attached to and extends downwardly from the housing 12. The outlet engagement 70 is electrically coupled to each of the first contact 32 and the second contact 36 and the outlet engagement 70 electrically engages a power source comprising a female electrical outlet 72 in the vertical support surface 14. Moreover, the outlet engagement 70 includes a cover 74 that is positionable over the female electrical outlet 50 in the vertical support surface 14. In this way the cover 74 inhibits access to the female electrical outlet 50 in the vertical support surface 14.

Figure 8:
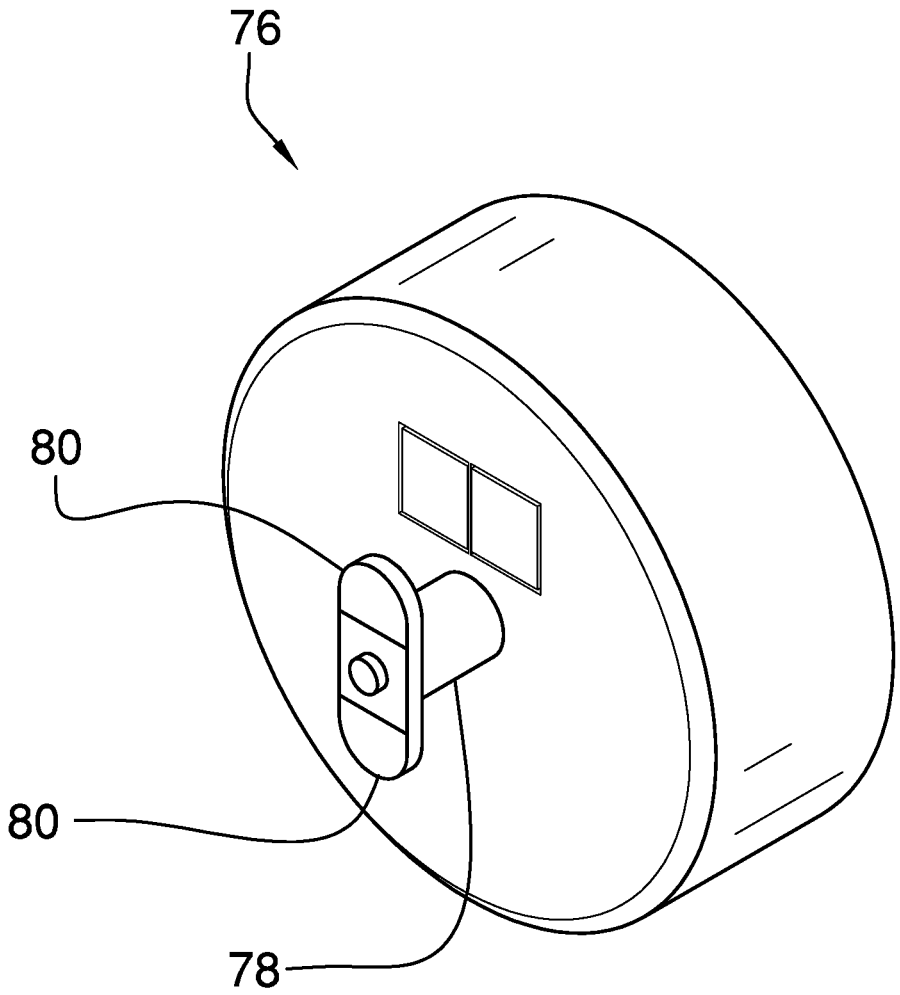
FIG. 8 is a back perspective view of an alternative embodiment of the disclosure.

In an alternative embodiment 76 as is most clearly shown in FIG. 8, each of the outlet units 42 includes a master contact 78 extending away from the rear side 48 of the block 44. The master contact 78 is electrically coupled to the female electrical outlet 50 and the master contact 78 includes a pair of tabs 80 that is each spaced from the rear side 48. Moreover, the tabs 80 extend in opposite directions from each other. Each of the tabs 80 engages a respective one of the first contact 32 and the second contact 36 when the block 44 is rotated into the locking position.

In use, the housing 12 is mounted to the vertical support surface 14 with best practice including, but not being limited to, wall penetrating screws, double sided adhesive or any other means of retaining the housing 12 on the vertical support surface 14. Each of the first contact 32 and the second contact 36 are wired into the electrical system of the building using best practices for electrical wiring. The outlet units 42 can be positioned at any location along the housing 12 to supply electrical power to an electrical device. In this way a room with limited electrical outlets can service a variety of electrical devices in almost any location in the room.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A sliding electrical outlet assembly for facilitating electrical outlets to be slidable along a wall, said assembly comprising:

a housing being configured to be coupled to a vertical support surface, said housing having a slot extending into an interior of said housing;

a first contact being integrated into said housing, said first contact being coextensive with said slot, said first contact being electrically coupled to a power source;

a second contact being integrated into said housing, said second contact being coextensive with said slot, said second contact being electrically coupled to the power source; and a plurality of outlet units, each of said outlet units being slidably insertable into said slot, each of said outlet units engaging said first contact and said second contact when said outlet units are rotated into a locked position wherein each of said outlet units is configured to supply electrical power for an electrical device, each of said outlet units being slidable along said slot wherein said plurality of outlet units is configured to facilitate electrical power for the electrical device to be located at a plurality of locations along the vertical support surface.

2. The assembly according to claim 1, wherein said housing has a first end, a second end and an outer wall extending therebetween, said outer wall having a front side and a back side, said housing being elongated between said first end and said second end, said housing having a chamber therein, said slot extending through said front side of said outer wall into said chamber, said slot extending substantially between said first end and said second end, said housing being oriented such that an axis extending through said first end and said second end is horizontally oriented, said back side of said outer wall abutting the vertical support surface, said chamber having a rear bounding surface.

3. The assembly according to claim 2, wherein said first contact is positioned on said rear bounding surface of said chamber, said first contact being coextensive with said slot, said first contact being offset from said slot, said first contact being comprised of an electrically conductive material.

4. The assembly according to claim 2, wherein said second contact is positioned on said rear bounding surface of said chamber, said second contact being coextensive with said slot, said second contact being offset from said slot having said second contact being spaced from said first contact, said second contact being comprised of an electrically conductive material.

5. The assembly according to claim 1, further comprising a barrier being coupled to said housing, said barrier covering said slot wherein said barrier is configured to inhibit debris from entering said slot, said barrier having a cut therein, said cut extending along a full length of said slot.

6. The assembly according to claim 1, wherein each of said outlet units comprises a block having a forward side and a rear side, said forward side having an female electrical outlet being integrated therein.

7. The assembly according to claim 6, wherein each of said outlet units includes a primary contact being coupled to said rear side, said primary contact being electrically coupled to said female electrical outlet.

8. The assembly according to claim 6, wherein said primary contact comprises a leg extending away from said rear side and a foot being spaced from said rear side, said foot extending upwardly along said block, said primary contact being extendable through said slot in said housing when said block is oriented in an inserting position.

9. The assembly according to claim 8, wherein said primary contact electrically engages said first contact when said block is rotated into a locking position wherein said female electrical outlet is configured to receive electrical power from the power source.

10. The assembly according to claim 8, wherein each of said outlet units includes a secondary contact being coupled to said rear side, said secondary contact being electrically coupled to said female electrical outlet.

11. The assembly according to claim 10, wherein said secondary contact comprises a leg extending away from said rear side and a foot being spaced from said rear side, said foot extending downwardly along said block, said foot of said secondary contact being offset from said foot of said primary contact, said secondary contact being extendable through said slot in said housing when said block is oriented in said inserting position.

12. The assembly according to claim 11, wherein said secondary contact electrically engages said second contact when said block is rotated into a locking position wherein said female electrical outlet is configured to receive electrical power from the power source.

13. A sliding electrical outlet assembly for facilitating electrical outlets to be slidable along a wall, said assembly comprising:

a housing being configured to be coupled to a vertical support surface, said housing having a slot extending into an interior of said housing, said housing having a first end, a second end and an outer wall extending therebetween, said outer wall having a front side and a back side, said housing being elongated between said first end and said second end, said housing having a chamber therein, said slot extending through said front side of said outer wall into said chamber, said slot extending substantially between said first end and said second end, said housing being oriented such that an axis extending through said first end and said second end is horizontally oriented, said back side of said outer wall abutting the vertical support surface, said chamber having a rear bounding surface;

a first contact being integrated into said housing, said first contact being coextensive with said slot, said first contact being electrically coupled to a power source, said first contact being positioned on said rear bounding surface of said chamber, said first contact being coextensive with said slot, said first contact being offset from said slot, said first contact being comprised of an electrically conductive material;

a second contact being integrated into said housing, said second contact being coextensive with said slot, said second contact being electrically coupled to the power source, said second contact being positioned on said rear bounding surface of said chamber, said second contact being coextensive with said slot, said second contact being offset from said slot having said second contact being spaced from said first contact, said second contact being comprised of an electrically conductive material;

a barrier being coupled to said housing, said barrier covering said slot wherein said barrier is configured to inhibit debris from entering said slot, said barrier having a cut therein, said cut extending along a full length of said slot; and a plurality of outlet units, each of said outlet units being slidably insertable into said slot, each of said outlet units engaging said first contact and said second contact when said outlet units are rotated into a locked position wherein each of said outlet units is configured to supply electrical power for an electrical device, each of said outlet units being slidable along said slot wherein said plurality of outlet units is configured to facilitate electrical power for the electrical device to be located at a plurality of locations along the vertical support surface, each of said outlet units comprising:

a block having a forward side and a rear side, said forward side having an female electrical outlet being integrated therein;

a primary contact being coupled to said rear side, said primary contact being electrically coupled to said female electrical outlet, said primary contact comprising a leg extending away from said rear side and a foot being spaced from said rear side, said foot extending upwardly along said block, said primary contact being extendable through said slot in said housing when said block is oriented in an inserting position, said primary contact electrically engaging said first contact when said block is rotated into a locking position wherein said female electrical outlet is configured to receive electrical power from the power source;

a secondary contact being coupled to said rear side, said secondary contact being electrically coupled to said female electrical outlet, said secondary contact comprising a leg extending away from said rear side and a foot being spaced from said rear side, said foot extending downwardly along said block, said foot of said secondary contact being offset from said foot of said primary contact, said secondary contact being extendable through said slot in said housing when said block is oriented in said inserting position, said secondary contact electrically engaging said second contact when said block is rotated into a locking position wherein said female electrical outlet is configured to receive electrical power from the power source.

14. The assembly according to claim 13, further comprising an outlet engagement being attached to and extending downwardly from said housing, said outlet engagement being electrically coupled to each of said first contact and said second contact, said outlet engagement electrically engaging a power source comprising a female electrical outlet in the vertical support surface, said outlet engagement including a cover being positionable over the female electrical outlet in the vertical support surface wherein said cover is configured to inhibit access to the female electrical outlet in the vertical support surface.

15. The assembly according to claim 13, wherein each of said outlet units includes a master contact extending away from said rear side of said block, said master contact being electrically coupled to said female electrical outlet, said master contact including a pair of tabs each being spaced from said rear side, said tabs extending in opposite directions from each other, each of said tabs engaging a respective one of said first contact and said second contact when said block is rotated into said locking position.

* * * * *